US005189401A

United States Patent [19]

Kugler, Jr. et al.

[11] Patent Number: 5,189,401

[45] Date of Patent: Feb. 23, 1993

[54] AX AND EGA VIDEO DISPLAY APPARATUS UTILIZING A VGA MONITOR

[75] Inventors: Donald W. Kugler, Jr., Frenchtown; Christopher D. Coley, Flemington; Jeffrey A. Walck, Lebanon, all of N.J.

[73] Assignee: Unisys Corporation, Blue Bell, Pa.

[21] Appl. No.: 715,207

[22] Filed: Jun. 14, 1991

[51] Int. Cl.[5] ..... G09G 1/28

[52] U.S. Cl. ..... 340/703; 340/701

[58] Field of Search ..... 340/703, 701, 799, 798, 340/724, 728, 745

[56] References Cited

U.S. PATENT DOCUMENTS 4,918,436 4/1990 Johary ..... 340/703

5,086,295 2/1992 Boettcher et al. ..... 340/703

*Primary Examiner*—Jeffery A. Brier

*Assistant Examiner*—A. Au

*Attorney, Agent, or Firm*—Albert B. Cooper; Mark T. Starr

[57] ABSTRACT

A PC video adapter board for driving a VGA color monitor, the board including a VGA video color palette DAC for providing analog color video to the monitor. A VGA controller provides VGA digital color video signals to the DAC through a first multiplexer and timing signals to the monitor through a second multiplexer. The board also includes EGA video controllers and a Japanese EGA (JEGA). A read/write register is written from the computer to contain additional EGA digital color bits for supplementing the six JEGA bits so as to provide a full eight bits of digital video in the EGA modes. The register provides a control bit to switch the first and second multiplexers between the VGA and EGA digital color video and timing signals. A further control bit from the register controls the third multiplexer either to send the GS and RS video signals from the JEGA directly to the first multiplexer to operate in a limited six bit mode or to send the supplementary bits to the first multiplexer to operate in an eight bit video mode. The horizontal sync and blanking signals from the EGA controllers are delayed by two pixel clock times to center EGA screens on the VGA monitor and registers in the EGA controllers are programmed to adjust the EGA snychronization timing for compatibility with the VGA monitor.

10 Claims, 2 Drawing Sheets

AX AND EGA VIDEO DISPLAY APPARATUS UTILIZING A VGA MONITOR

BACKGROUND OF THE INVENTION

1. Field of the Invention

The invention relates to personal computer (PC) or workstation architecture particularly with respect to text and graphics displays on the monitor thereof. The invention specifically concerns the display of Japanese characters in a text mode and the support of standard EGA display modes for English and other western language text and EGA graphics.

2. Description of the Prior Art

Three different protocols are presently utilized for the generation of computer text and graphics on a monitor; viz., the EGA standard, the VGA standard and the Architecture Extended (AX) standard. The EGA standard, which was the first to be established, utilizes a digital EGA monitor that accepts digital video signals from the video controller. The EGA standard utilizes six bits of digital video to define 64 colors. Conversion circuitry in the EGA monitor transforms the digital video signals to the appropriate drive signals for the color gun system of the monitor. The EGA standard utilizes a resolution of 640×350 pixels in the text modes and the standard EGA monitor includes horizontal and vertical oscillators tuned to accept horizontal and vertical synchronization frequencies appropriate for this mode of operation. As is well known, such oscillators utilize phase locked loop circuitry capable of locking to the horizontal and vertical sync signals over narrow frequency ranges. The EGA standard utilizes a 9×13 pixel character matrix in text display modes.

Although the resolution of 640×350 pixels is adequate for the display of English language and other western language text as well as for some graphics modes, higher resolutions of, for example, 640×480 pixels is required for high resolution graphics displays. EGA systems that support text and high resolution graphics require the use of a multi-sync monitor. A multi-sync monitor contains a plurality of horizontal and/or vertical oscillators for synchronizing to the various horizontal and vertical sync frequencies required for the low to high resolution EGA modes and thus has the capability of displaying video at a plurality of horizontal and vertical sync frequencies. Present day EGA multi-sync monitors tend to be extremely expensive because of the complex plural synchronization requirements. Additionally, such monitors are not widely and commonly utilized and hence have not benefited from large scale mass production economies. The EGA system utilizes a standard EGA chip set and associated software.

In such systems, it is desirable to display Japanese fonts and characters on the monitor screen in text modes of operation. Japanese fonts include Kanji, Hirekana and Katakana. The Kanji character set includes over 8000 characters. These fonts are utilized for writing and processing Japanese text on a PC architecture computer. However, because of the complexity of Japanese characters compared, for example, to English alphabet characters, EGA text mode standards are inadequate to provide a display of clearly distinguishable and easily readable Japanese text. This inadequacy results primarily from the resolution and character matrix size utilized in the text mode of the EGA standard. It would be possible, however, to generate reasonable quality Japanese text on an EGA monitor utilizing an EGA graphics mode. Equipment operating in a graphics mode is generally slower than text mode oriented equipment. In a graphics mode, the screens of Japanese text would be generated at an inadequate speed to provide acceptable display performance in text oriented applications such as word processing.

The Architecture Extended (AX) standard was developed for providing high performance and high speed display of Japanese characters in a text mode of operation, thus providing adequate support for the generation and display of Japanese characters. The AX standard supports EGA modes (AX-EGA), so that both Japanese and English text can be displayed utilizing the same system. In the AX mode for the display of Japanese characters, a resolution of 640×480 pixels and a character matrix of 16×16 pixels is utilized to properly support the display of the complex Japanese characters. As previously described, the EGA text mode standard utilizes a resolution of 640×350 pixels. In order to support the diverse resolutions required in the Japanese AX mode and in the EGA English mode, a multi-sync monitor is required. Although multi-sync monitors can support most text and graphics modes, the multi-sync monitor is extremely expensive. Additionally, only the limited number of colors available under the EGA standard are displayed. It is appreciated that the AX mode utilizes the standard JEGA chip set (Japanese EGA).

The VGA standard was developed to provide significantly enhanced modes and capabilities with respect to the EGA system. The VGA protocol has substantially replaced the EGA system and is now utilized as the industry standard. EGA equipment is still, however, utilized and supported.

The VGA monitor is an analog monitor that receives analog video signals from the CPU. The VGA standard supports 256 simultaneous colors from a palette of 256K colors, and all text and graphics modes with resolution formats ranging from 320×200 pixels to 640×480 pixels. The VGA character matrix is 9×14 pixels. The VGA monitor is a "verisync" monitor in that the monitor supports numerous resolution formats without a plurality of horizontal and vertical oscillators as in the multi-sync monitor. The VGA monitor utilizes only one horizontal oscillator and only one vertical oscillator. The VGA standard supports the various text and graphics modes with plugable circuit boards within the CPU that provide logic and programming, in a well-known manner, such that the various required resolutions are properly effected by the VGA monitor. Logic, implementing clock alterations and pixel combinations and the like, effects the various modes.

Notwithstanding the enhanced capability of the VGA standard, the VGA monitor is significantly less expensive than the EGA monitor because of the analog video simplicity and the single horizontal and vertical oscillator requirements thereof. Additionally, since the VGA monitor is currently the most widely used type, large scale mass production has resulted in greatly reducing the price thereof. Thus, the VGA monitor is significantly less expensive than the EGA monitor and extremely more economical than the multi-sync EGA monitor.

Although the VGA standard supports all known graphics and English language text modes, the VGA system does not adequately support the display of Japanese text for the reasons discussed above with respect to the EGA standard. Thus, the current state of the art is that the AX-EGA standard exists for supporting Japanese text and EGA modes but requires an extremely expensive multi-sync EGA monitor. The industry standard VGA protocol provides enhanced capabilities and supports significantly more modes than the prior EGA standard, but is unsuitable for the display of Japanese text.

SUMMARY OF THE INVENTION

It is a desideratum of the present invention to utilize the VGA monitor, which is significantly less expensive than the multi-sync EGA monitor, to fully support EGA modes and, in particular, the AX mode of displaying Japanese characters. It is desirable to provide the EGA modes with the full color capabilities of a VGA environment. Heretofore this has not been possible. In the preferred embodiment, the enhanced VGA modes and capabilities are also supported.

The present invention achieves these objectives by coupling the EGA digital video color bits as inputs to a VGA video color palette DAC which provides the analog video color signals for driving the VGA monitor. The standard EGA digital video color bits are fewer in number than the standard VGA digital color bits. Means are included for combining supplementary EGA digital video color bits with the standard EGA digital video color bits to provide the same number of digital video color bits as in the VGA environment so as to fully access the VGA video color palette DAC.

In the preferred embodiment, the EGA and JEGA video controller circuitry are interfaced with a VGA video controller for driving the VGA monitor through the video color palette DAC. The VGA digital video color bits are applied as first inputs to a multiplexer having outputs providing the digital video color bit inputs to the DAC. The EGA controller digital video color bits, combined with the supplementary EGA digital video color bits, provide second inputs to the multiplexer. A mode enabling signal controls the multiplexer to apply either the VGA or EGA bits to the DAC in accordance with the active mode.

In addition, the sync timing of the EGA circuitry is adjusted for compatibility with the standard VGA monitor and the EGA horizontal sync and blanking signals are delayed by a predetermined number of pixel clock times to center the EGA screens on the VGA monitor. In the preferred embodiment, the delayed horizontal sync and blanking signals, along with the vertical sync signal from the EGA circuitry, are multiplexed with the standard blanking, horizontal sync and vertical sync signals from the VGA controller to provide blanking to the DAC and timing signals to the monitor, in accordance with whether the system is operating in a VGA or EGA mode.

DESCRIPTION OF THE PREFERRED EMBODIMENT

Figures 1, 1A, 1B:
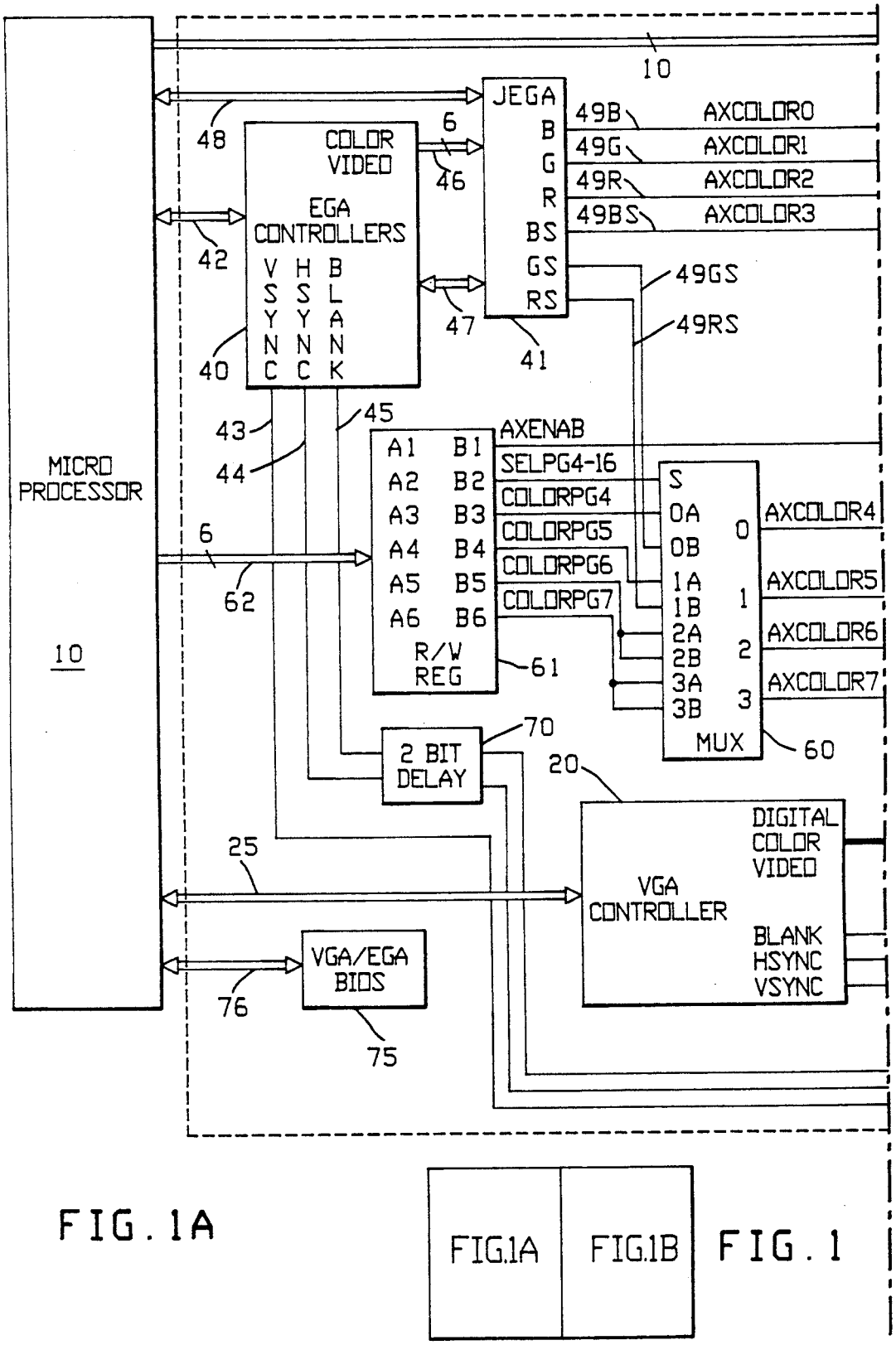
FIG. 1, comprised of FIGS. 1A and 1B, is a schematic block diagram of a video controller interfacing EGA and JEGA devices into a VGA architecture for driving a VGA monitor.
Figure 1B:
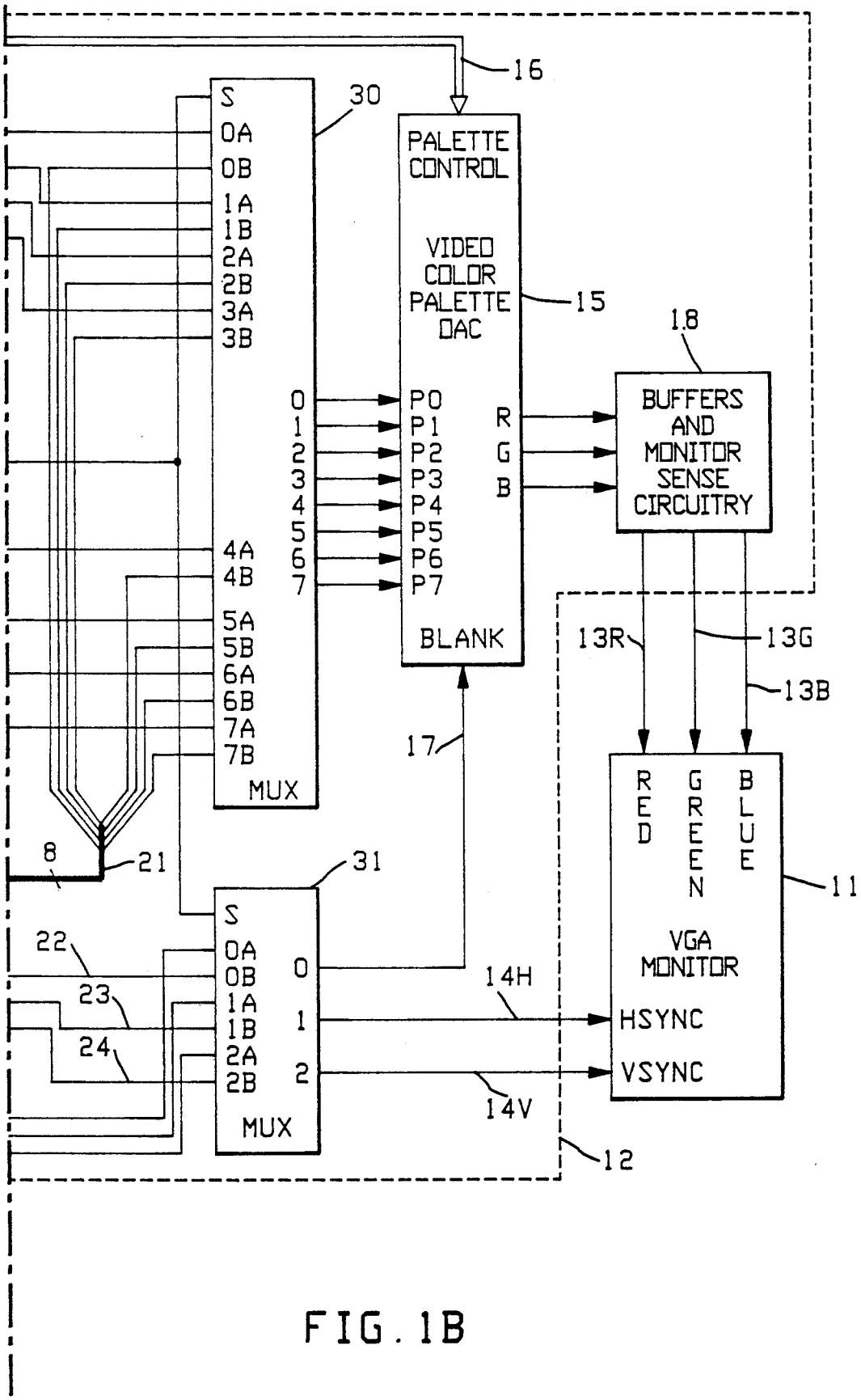

Referring to FIG. 1, a system based on a standard PC architecture with VGA capabilities is illustrated. A microprocessor 10 drives a standard VGA color monitor 11 through a video adapter board 12. The VGA monitor 11 includes standard Red, Green and Blue analog color video inputs 13R, 13G and 13B as well as inputs 14H and 14V for conventional horizontal and vertical synchronization signals. The analog color video signals for the VGA monitor 11 are provided by a video color palette DAC 15.

A video color palette DAC is a standard element in a VGA video adapter board and converts eight bits of VGA digital color video into the analog Red, Green and Blue video signal levels required for generating one out of 256 simultaneously available colors. The eight bits of digital video are applied at inputs P0–P7 of the DAC 15. The analog video outputs are denoted as R, G, and B. The video color palette DAC 15 includes a digital-to-analog converter (DAC) for converting the digital video to analog video and provides the simultaneously selectable 256 colors from a palette of 262,144 (256K) colors. The selection of the 256 simultaneously available colors is effected by ten palette control bits from the microprocessor 10 on a bus 16. The 256 simultaneously available colors are considered to comprise sixteen pages of sixteen colors each where the hues on the pages are determined by the ten palette control bits on the bus 16. The details of color selection utilizing the P0–P7 digital video inputs and the ten bits of palette control are well known in the VGA technology.

The video color palette DAC 15 also includes a blanking input 17 for turning off the R, G and B video output signals when the monitor screen should be blank. The video color palette DAC 15 is preferably implemented by a Brooktree BT476-50 DAC.

The analog color video signals R, G and B from the DAC 15 are applied to the VGA monitor 11 through standard buffers and monitor sense circuitry 18. In a conventional manner, the circuitry 18 buffers the analog video signals and is utilized by the VGA controller to detect the type of monitor connected into the system.

The video adapter board 12 includes a conventional VGA controller 20. The controller 20 provides eight bits of digital color video at outputs 21 as well as conventional blanking, horizontal synchronizing and vertical synchronizing signals on outputs 22–24, respectively. In a conventional VGA environment, the eight digital color video bits on the outputs 21 are connected directly to the inputs P0–P7 of the DAC 15, respectively. Similarly, the blanking signal on the output 22 is normally connected directly to the blanking input 17 of the DAC 15, while the horizontal and vertical synchronizing signals on the outputs 23 and 24 are normally connected directly to the horizontal and vertical synchronizing inputs 14H and 14V, respectively, of the VGA monitor 11. The VGA controller 20 interacts with the microprocessor 10 via a bus 25 in a well known manner. The VGA controller 20 is preferably implemented by a PVGA1B controller chip.

In accordance with the invention, EGA video devices are interfaced to the VGA DAC 15 by multiplexers 30 and 31. The multiplexer 30 receives eight pairs of EGA/VGA digital color video signals as inputs and selectively applies either the eight EGA signals or the eight VGA signals to the eight multiplexer outputs, respectively, in accordance with a selector signal applied to the S input thereof. The eight outputs of the multiplexer 30 are denoted as 0, 1, . . . , 7 and are connected to the respective P0, P1, . . . , P7 inputs of the DAC 15. The selection signal applied to the S input of the multiplexer 30 is denoted as AXENAB and selects between the VGA and EGA modes of operation. Specifically, the eight digital color video signals from the VGA controller 20 are connected, respectively, to the "B" inputs of the multiplexer 30 and are thereby connected, respectively, to the DAC inputs P0–P7 when the video adapter board 12 is controlled to operate in the VGA mode.

In a similar manner, the blanking, horizontal synchronizing and vertical synchronizing signals from the VGA controller 20 are applied to the "B" inputs of the multiplexer 31 and are thus applied to the blanking input 17 of the DAC 15 and the horizontal and vertical synchronizing inputs of the monitor 11, respectively, when the video adapter board 12 is controlled to operate in the VGA mode. Preferably, the multiplexers 30 and 31 are implemented by 74F157 chips.

The video adapter board 12 includes standard EGA circuitry, such as EGA controllers 40 and a Japanese EGA (JEGA) chip 41. The EGA controllers 40 may be configured in any known master or master-slave configuration, such as a C+T 435/6 arrangement. Specifically, such EGA chips as the 82A436 and 82C435 may be utilized. The EGA controllers 40 interact with the microprocessor 10 via a bus 42 in a conventional manner. The controllers 40 provide master EGA synchronization and blanking signals, such as the vertical synchronizing signal on an output 43, the horizontal synchronizing signal on an output 44 and the blanking signal on an output 45. The EGA controllers 40 also provide six bits of digital color video to the JEGA 41 on a bus 46 in a conventional manner. These six EGA color video bits are denoted in the technology as Blue, Green, Red, Blue Secondary, Green Secondary and Red Secondary (B, G, R, BS, GS and RS). It is appreciated that if a master-slave configuration is utilized, the bus 46 may convey six bits of master color video and six bits of slave color video to the JEGA 41. The EGA controllers 40 and the JEGA chip 41 interact with respect to each other in a conventional manner via a bus 47.

The JEGA chip 41 provides the six standard EGA digital video color bits on outputs 49B, 49G, 49R, 49BS, 49GS and 49RS, respectively, and interacts with the microprocessor 10 in a conventional manner via a bus 48. The JEGA chip 41 is preferably implemented as an ASCII JEGA by a 6367A chip.

In accordance with the invention, eight EGA digital video color bits are provided and are denoted as AXCOLOR0–AXCOLOR7. The AXCOLOR0 through AXCOLOR7 bits are applied, respectively, to the "A" inputs of the multiplexer 30 and are selected for application to the respective inputs P0 through P7 of the DAC 15 when the video adapter board 12 is operating in an EGA mode. The AXCOLOR0 through AXCOLOR3 signals are derived directly from the B, G, R and BS video bits, respectively, from the JEGA 41. When operating in an EGA mode B, G, R and BS are applied directly to palette DAC inputs P0–P3, respectively. These bits are appropriate for accessing one page (sixteen simultaneous colors) out of the 256 pages of the standard RAM look-up tables of the palette DAC 15. Even when GS and RS from the JEGA 41 are combined with B, G, R and BS, only four pages, or sixty-four simultaneous colors, are accessed in the palette DAC 15.

In accordance with the invention, a multiplexer 60 provides the AXCOLOR4 through AXCOLOR7 signals to respective "A" inputs of the multiplexer 30. Thus, in an EGA mode, AXCOLOR4 through AXCOLOR7 are applied by the multiplexer 30 to the respective P4 through P7 inputs of the palette DAC 15. In this manner, access is gained to the full sixteen pages within the palette DAC 15 to provide 256 simultaneous colors. The ten palette control bits on the bus 16 are utilized, in a conventional manner, to access all 256K colors within the DAC 15. The multiplexer 60 is preferably implemented by a 74F157 chip.

Further in accordance with the invention, a six bit read/write register 61 is included for providing four supplementary enhancement EGA color bits denoted as COLORPG4–COLORPG7 as respective "A" inputs to the multiplexer 60. The register 61 also provides a bit denoted as SELPG4_16 which is connected to the select input S of the multiplexer 60. The SELPG4_16 signal selects between providing four color pages or the full sixteen color pages from the palette DAC 15. The register 61 also provides a bit denoted as AXENAB which is connected to the S inputs of the multiplexers 30 and 31. Thus, AXENAB controls the multiplexers 30 and 31 in accordance with whether a VGA or EGA mode is operative.

The GS and RS outputs of the JEGA 41 are connected to "B" inputs of the multiplexer 60. The multiplexer 60 selects between GS from the JEGA 41 and COLORPG4 to provide AXCOLOR4. Similarly, the multiplexer 60 selects between RS from the JEGA 41 and COLORPG5 to provide AXCOLOR5. COLORPG6 and COLORPG7 are connected both to the "A" and "B" inputs of the multiplexer 60 to provide AXCOLOR6 and AXCOLOR7, respectively. The microprocessor 10 writes the six bits into the read/write register 61 via a bus 62. The register 61 is preferably implemented by a 74LS652 chip.

For normal six bit EGA modes, SELPG4_16 is set to the four page level, controlling the multiplexer 60 to connect the "B" inputs to the respective multiplexer outputs. In this mode of operation, the COLORPG6 and COLORPG7 signals are set to zero driving AXCOLOR6 and AXCOLOR7 to zero. In this mode of operation GS and RS from the JEGA 41 are selected by the multiplexer 60 to provide AXCOLOR4 and AXCOLOR5, respectively. Alternative to setting COLORPG6 and COLORPG7 to zero, the inputs 2B and 3B of the multiplexer 60 could be permanently connected to a source of logic "0" instead of being shorted to the respective "A" inputs.

When an enhanced EGA mode is operative, SELPG4_16 is set to the select sixteen page level, controlling the multiplexer 60 to select the "A" inputs for connection to the respective multiplexer outputs. Thus in the enhanced EGA modes, COLORPG4–COLORPG7 provide the AXCOLOR4–AXCOLOR7 video bits, respectively.

The master EGA timing and blanking signals on the outputs 43–45 are coupled to the "A" inputs of the multiplexer 31 with the horizontal synchronizing and blanking signals coupled to the multiplexer 31 through a two-bit delay 70. The two-bit delay 70 delays the horizontal synchronizing and blanking signals by two pixel clock times; i.e. the time required to display two consecutive pixels on the screen. The two-bit delay 70 is preferably implemented by a parallel-in, parallel-out register such as a 74F174. The horizontal synchronizing and blanking signals on the outputs 44 and 45 are reentrantly passed through the register for two pixel clock times so as to effect the two-bit delay. The two-bit delay 70 is provided so that EGA screens are centered on the VGA monitor 11.

Standard VGA and EGA BIOS programs 75 communicate with the microprocessor 10 via a bus 76 to provide basic input/output functions with respect to the VGA controller 20 and the EGA controllers 40 in a well known manner.

In operation, when a VGA application is active, the microprocessor 10 sets the AXENAB signal in the register 61 to the VGA mode. The AXENAB signal, when controlling the VGA mode, sets the multiplexers 30 and 31 to connect the "B" inputs to the respective outputs thereof. Thus, in the VGA mode of operation, the VGA digital color video bits on the outputs 21 are applied by the multiplexer 30 the P0–P7 inputs of the palette DAC 15. In the VGA mode, the blanking and timing signals from the VGA controller 20 are applied to the blanking input of the DAC 15 and the horizontal and vertical sync timing inputs of the monitor 11, respectively.

When an EGA mode is active, the microprocessor 10 sets AXENAB to EGA, thereby controlling the multiplexers 30 and 31 to connect the "A" inputs thereof to the respective outputs. Thus, in the EGA modes, AXCOLOR0 through AXCOLOR7 provide the digital color video inputs to P0–P7, respectively, of the palette DAC 15. In the EGA modes, the master EGA synchronizing and blanking signals from the EGA controllers 40 provide the blanking and timing functions to the palette DAC 15 and VGA monitor 11. When an enhanced EGA mode is active, the microprocessor 10 sets the SELPG4_16 to the select sixteen pages mode thereby utilizing COLORPG4–COLORPG7 as the AXCOLOR4–AXCOLOR7 signals, respectively. When a normal six bit EGA mode is active, the microprocessor 10 sets SELPG4_16 to the select four pages mode and sets COLORPG6 and COLORPG7 to zero. Thus, GS and RS from JEGA 41 are utilized as AXCOLOR4 and AXCOLOR5, respectively, and AXCOLOR6 and AXCOLOR7 are set to zero.

The buses 16, 25, 42, 62 and 76 are schematically illustrated as providing dedicated connections between the microprocessor 10 and the associated elements of the video adapter board 12. It is appreciated that in an actual PC system, address and data buses, such as an AT bus, provide addressable inter-communication between the microprocessor 10 and the components of the video adapter board 12 in a well known manner.

The microprocessor 10 sets the AXENAB and SELPG4_16 bits in accordance with the user application being executed or the user desired operating mode. Simple programming of the type familiar to video controller programmers may be utilized in the operating system, an extension to the operating system, a secondary control program, the BIOS 75 or an extension of the BIOS 75 to generate the AXENAB and SELPG4_16 control bits. Thus, the operating system can automatically effect the VGA mode, EGA mode or enhanced EGA mode in accordance with the application being executed. For example, when running a Japanese word processing application, AXENAB is set to EGA and SELPG4_16 is set to select sixteen pages.

In a similar manner, the COLORPG4 through COLORPG7 signals are provided by simple coding in the operating system, an extension to the operating system, a secondary control program, the BIOS 75 or an extension of the BIOS 75. Such coding is familiar to VGA video controller programmers and is similar to the coding utilized to provide comparable VGA digital color bits. Since the mapping of the video color palette DAC 15 from the digital video color input bits to the analog color output levels is predetermined and known, it is routine for those skilled in VGA video controller programming to provide the coding for generating the appropriate COLORPG4 through COLORPG7 bits.

Thus, the signals COLORPG4 through COLORPG7 are utilized at the discretion of the user to provide enhanced color selection capabilities in EGA and AX modes comparable to that available in the VGA environment.

In addition to the two-bit delay 70 that centers the EGA screens onto the VGA monitor and turns off the outputs of the palette DAC 15 during the times when no information is displayed on the screen, minor modifications are programmed with respect to the values in registers in the EGA controllers 40 to adjust the video sync timing for compatibility with the standard VGA monitor. Modifications of this type are conventional and well known and are explained in the EGA controller manuals.

Although the above described embodiment of the invention was explained in terms of incorporating EGA devices into a VGA environment, it is appreciated that the invention may also be utilized for adapting an EGA environment to the utilization of an inexpensive VGA monitor. This is accomplished by interfacing the EGA video devices to a VGA video palette DAC, in the manner described herein, to permit the digital video devices to drive an analog VGA monitor display. Modification of the video timing within the EGA devices provides proper screen centering and synchronization, permitting the display of Japanese AX video on the VGA monitor. Prior art systems for displaying Japanese AX video required a high cost, multisync video monitor displaying a limited number of colors. The present invention obviates these disadvantages.

In the present invention, the digital video signals AXCOLOR0–AXCOLOR7 are converted by the DAC 15 to the three primary analog colors. The multiplexer 60 is utilized to access the full sixteen pages within the DAC. Without the multiplexer 60 only four pages are accessible, since the JEGA 41 only provides six bits of digital video.

While the invention has been described in its preferred embodiment, it is to be understood that the words which have been used are words of description rather than limitation and that changes may be made within the purview of the appended claims without departing from the true scope and spirit of the invention in its broader aspects.

We claim:

1. Apparatus for interfacing EGA video controller means to an analog VGA monitor normally driven from a VGA video controller, said EGA video controller means providing EGA digital video color bits, said VGA video controller normally generating VGA digital video color bits, said EGA digital video color bits being fewer in number than said VGA digital video color bits, comprising:

supplementing means for providing supplementary EGA digital video color bits, said supplementary EGA digital video color bits being combined with said EGA digital video color bits from said EGA video controller means to provide combined EGA digital video color bits equal in number to said VGA digital video color bits, a VGA video controller for providing said VGA digital video color bits, a digital processor interactively coupled with said VGA video controller and said EGA video controller means, and a VGA video color palette DAC responsive to said combined EGA digital video color bits and coupled to said VGA monitor for driving said VGA monitor with analog video color signals in accordance with said combined EGA digital video color bits, said VGA video color palette DAC being responsive to said VGA digital video color bits.

2. The apparatus of claim 1 wherein said EGA video controller means provides horizontal and vertical synchronization signals, said apparatus further including delay means responsive to at least one of said synchronization signals for delaying said one synchronization signal by a predetermined number of pixel clock times so as to appropriately position EGA screens on said VGA monitor.

3. The apparatus of claim 1 wherein said supplementing means includes multiplexing means responsive to predetermined ones of said EGA digital video color bits for switchably coupling said predetermined ones of said EGA digital video color bits or said supplementary EGA digital video color bits to said VGA video color palette DAC.

4. The apparatus of claim 1 wherein said VGA video controller further provides horizontal and vertical synchronization signals.

5. The apparatus of claim 4 wherein said supplementing means comprises register means coupled to said processor for receiving data therefrom, said register means including a first bit position for containing a first control bit for selecting between VGA operation and EGA operation, a second bit position for containing a second control bit for selecting between normal EGA operation and enhanced EGA operation and further bit positions for containing said supplementary EGA digital video color bits, and first multiplexing means coupled to said register means and responsive to predetermined ones of said EGA digital video color bits, said first multiplexing means having a selection control input and an output, said selection control input being responsive to said second control bit, said first multiplexing means switchably providing to said output either said predetermined ones of said EGA digital video color bits or said supplementary EGA digital video color bits in accordance with said second control bit, said EGA digital video color bits from said EGA video controller means and said bits at said output of said first multiplexing means comprising said combined EGA digital video color bits.

6. The apparatus of claim 5 further including second multiplexing means having a selection control input and an output, said output being coupled to said video color palette DAC, said selection control input of said second multiplexing means being responsive to said first control bit from said register means, said second multiplexing means being responsive to said combined EGA digital video color bits and to said VGA digital video color bits for switchably coupling either said combined EGA digital video color bits or said VGA digital video color bits to said output in accordance with said first control bit, said video color palette DAC driving said VGA monitor with analog video color signals in accordance with said digital video color bits provided at said output of said second multiplexing means.

7. The apparatus of claim 6 wherein said EGA controller means provides horizontal and vertical synchronization signals, said apparatus further including delay means responsive to at least one of said synchronization signals for delaying said one synchronization signal by a predetermined number of pixel clock times to provide a delayed synchronization signal so as to appropriately position EGA screens on said VGA monitor, the other synchronization signal being undelayed.

8. The apparatus of claim 7 further including third multiplexing means having a selection control input and an output, said output being coupled to synchronization inputs of said VGA monitor, said selection control input of said third multiplexing means being responsive to said first control bit from said register means, said third multiplexing means being responsive to said delayed and undelayed synchronization signals from said EGA controller means and to said horizontal and vertical synchronization signals from said VGA controller for selectively providing to said synchronization inputs of said VGA monitor, either said synchronization signals from said EGA controller means or said synchronization signals from said VGA controller in accordance with said first control bit.

9. The apparatus of claim 5 wherein said EGA video controller means includes a Japanese EGA video controller for providing said EGA digital video color bits.

10. The apparatus of claim 8 wherein said EGA video controller means includes registers programmed to adjust timing of said synchronization signals from said EGA controller means for compatibility with said VGA monitor.

* * * * *